US005778463A

United States Patent [19]

Teckchandani et al.

[11] Patent Number: 5,778,463

[45] Date of Patent: Jul. 14, 1998

[54] MULTI-PIECE TUB/SHOWER UNIT AND METHOD OF INSTALLATION

[75] Inventors: Lal D. Teckchandani, Poland, Ohio; Larry I. Fairchild, New Wilmington; Becky J. Fennell, New Castle, both of Pa.

[73] Assignee: Universal Rundle Corporation, New Castle, Pa.

[21] Appl. No.: 723,099

[22] Filed: Oct. 1, 1996

[51] Int. Cl.[6] ..... A47K 3/02

[52] U.S. Cl. ..... 4/538; 4/584; 49/411

[58] Field of Search ..... 4/538, 584, 592, 4/515, 595; 49/403, 410, 411

[56] References Cited

U.S. PATENT DOCUMENTS

| | | | |
|---|---|---|---|
| 2,211,513 | 8/1940 | Nagin . | |
| 3,104,194 | 9/1963 | Zahorski . | |
| 3,112,532 | 12/1963 | Slowinski . | |
| 3,257,764 | 6/1966 | Cripe . | |
| 3,607,592 | 9/1971 | Jenkins . | |
| 3,827,088 | 8/1974 | Seymour et al. | 4/584 |
| 3,849,237 | 11/1974 | Zetlin . | |
| 3,906,571 | 9/1975 | Zetlin . | |
| 4,067,071 | 1/1978 | Atman et al. | 4/145 |
| 4,185,440 | 1/1980 | Finsterwalder . | |
| 4,356,678 | 11/1982 | Andrews et al. . | |
| 4,588,443 | 5/1986 | Bache . | |

(List continued on next page.)

FOREIGN PATENT DOCUMENTS

| | | |
|---|---|---|
| 0 413 500 | 2/1991 | European Pat. Off. . |
| WO 94/25682 | 11/1994 | WIPO . |

OTHER PUBLICATIONS

*Standard Specifications for Highway Bridges*, 15th Edition (1992), American Association of State Highway and Transportation Officials, Inc., Washington, D.C., 13 pp.

*Introduction to Composites*, Third Edition, The Composites Institute of the Society of the Plastics Industry, Inc. (released Jan., 1995), pp. 67–84.

"Plastics & Composites In Construction", Engineering News-Record, ENR Special Advertising Section (Nov. 1995), 20 pp.

Goldstein, "Catching Up On Composites", Civil Enginering (Mar. 1996), pp. 47–49.

Head, "High Performance Structural Materials Advanced Composites", draft of paper to be given at the Copenhagen IABSE Conference, Copenhagen, Denmark, Jun. 1996, 18 pp.

(List continued on next page.)

*Primary Examiner*—David J. Walczak

*Attorney, Agent, or Firm*—Kellie M. Muffoletto-Ulrich

[57] ABSTRACT

A multi-piece tub/shower unit having a trackless shower door and a method of assembly and installation of the same wherein the multi-piece tub/shower unit is comprised of a first sidewall, having a sidewall nailing flange and a front flanged surface, and a shower door water retaining bead as an integral part of the front flanged surface and further comprising at least one point of assembly having a debossed aperture; a backwall, having a backwall nailing flange and at least one point of assembly having a debossed aperture, whereby the backwall and the first sidewall are interconnected at the point of assembly by a christmas tree clip, having a first ribbed shank, a second ribbed shank and a shank head, whereby the christmas tree clip is inserted flushly within the debossed aperture of the point of assembly; the multi-piece tub/shower unit is further comprised of a bathtub unit having a tub nailing flange and a tub top ledge wherein the tub top ledge is comprised of an apron ledge having a shower door water retaining bead; the bathtub unit being further comprised of a first front corner which flushly receives the front flange surface of the first sidewall; and a trackless shower door assembly comprised of a first shower door, a second shower door, a header assembly and a center guide, wherein the first shower door and the second shower door are slidably secured within and between the header assembly and the center guide.

7 Claims, 7 Drawing Sheets

U.S. PATENT DOCUMENTS

| | | | |
|---|---|---|---|
| 4,629,358 | 12/1986 | Springston et al. . | |
| 4,706,319 | 11/1987 | Sivachenko et al. . | |
| 4,709,456 | 12/1987 | Iyer . | |
| 4,788,269 | 11/1988 | Vu et al. . | |
| 4,982,538 | 1/1991 | Horstketter . | |
| 4,987,619 | 1/1991 | Smith | 4/595 |
| 4,991,248 | 2/1991 | Allen . | |
| 5,092,137 | 3/1992 | Elsom | 62/408 |
| 5,205,098 | 4/1993 | Landis et al. . | |

OTHER PUBLICATIONS

Head, P.R., "Advanced Composites in Civil Engineering — A Critical Overview At This High Interest, Low Use Stage of Development", pp. 3–15 (El–Badry, Mamdouh, Ed., Advanced Composite Materials in Bridges and Structures, 2nd Annual Conference, Aug. 11–14, 1996; The Canadian Society for Civil Engineering (1996)).

Seible, F., "Advanced Composites Materials For Bridges In The 21st Century", pp. 17–30 (El–Badry, Mamdouh, Ed. Advanced Composite Materials in Bridges and Structures, 2nd Annual Conference, Aug. 11–14, 1996; The Canadian Society for Civil Engineering (1996)).

Cosenza, E., et al., "Experimental Evaluation Of Bending And Torsional Deformability Of FRP Pultruded Beams", pp. 117–124 (El–Badry, Mamdouh, Ed., Advanced Composite Materials in Bridges and Structures, 2nd Annual Conference, Aug. 11–14, 1996; The Canadian Society for Civil Engineering (1996)).

Sheard, P., et al., "Eurocrete —Using Advanced Composites To Reinforce Durable Concrete Structures", pp. 159–164, (El–Badry, Mamdouh, Ed., Advanced Composite Materials In Bridges and Structures, 2nd Annual Conference, Aug. 11–14, 1996; The Canadian Society for Civil Engineering (1996)).

Aref, A., et al., "Design and Analysis Procedures For A Novel Fiber Reinforced Plastic Bridge Deck", pp. 743–750 (El–Badry, Mamdouh, Ed., Advanced Composite Materials in Bridges and Structures, 2nd Annual Conference, Aug. 11–14, 1996; The Canadian Society for Civil Engineering (1996)).

Karbhari, V.M., "Fiber Reinforced Composite Decks For Infrastructure Renewal", pp. 759–766 (El–Badry, Mamdouh, Ed., Advanced Composite Materials In Bridges and Structures, 2nd Annual Conference, Aug. 11–14, 1996; The Canadian Society for Civil Engineering (1996)).

Johansen, G. Eric, et al., "Design And Construction of Two FRP Pedestrian Bridges In Haleakala National Park, Maui, Hawaii", pp. 975–982 (El–Badry, Mamdough, Ed., Advanced Composite Materials in Bridges and Structures, 2nd Annual Conference, Aug. 11–14, 1996; The Canadian Society for Civil Engineeirng (1996)).

Johansen et al., "Design of an Advanced Composite Material Space Frame System", pp. 1–9 of Session 7–B [Composites Institute's 51st Annual Conference & Expo '96, Feb. 5–7, 1996; SPI Composites Institute (1996)].

Gentry, "Application and Performance of Sandwich Panel Composites for Transportation Facilities", pp. 1–6 of Session 7–C [Composites Institute's 51st Annual Conference & Expo '96, Feb. 5–7, 1996; SPI Composites Institute (1996)].

Johansen, "Advanced Composite Material Support Frames: An Evaluation of the Bow Meadow Bridge at Lake Crescent, WA", pp. 1–9 of Session 7–D [Composites Institute's 51st Annual Conference & Expo '96, Feb. 5–7, 1996; SPI Composites Institute (1996)].

Barbero et al., "Stiffening of Steel Stringer Bridges with Carbon Fiber Reinforced Plastics for Improved Bridge Rating", pp. 1–3 of Session 7–E [Composites Institute's 51st Annual Conference & Expo '96, Feb. 5–7, 1996; SPI Composites Institute (1996)].

Meeter, "Designing Structural Sandwich Composties", pp. 1–6 of Session 8–D [Composites Institute's 51st Annual Conference & Expo '96, Feb. 5–7, 1996; SPI Composites Institute (1996)].

Churchman, Allan E., "Design Considerations for Advanced Composite Materials", 7 pp. [Fiberglass–Composite Bridges Seminar, 13th Annual Bridge Conference and Exhibition (Jun. 3, 1996)].

Witcher, Daniel A., "Processing and Fabricating FRP Composites For Bridge Structures", 9 pp. [Fiberglass–Composite Bridges Seminar, 13th Annual Bridge Conference and Exhibition (Jun. 3, 1996)].

Busel, John, Ed., *FRP Composites in Construction Applications*, A Profile in Progress, SPI Composites Institute (Nov., 1995), pp. 11–13, 15–16, 19–20, 49, 51–52, 58, 61, 73–74, 76–78, and 81.

"Tom's Creek Bridge Rehabilitation & Field Composite Durability Study", Virginia Tech; Virginia Transporation Research Council; Morrison Molded Fiber Glass (1996), 2 pages.

Sterling, Vikrell advertisement –no date.

Las Co, Fiberglass bath fixtures technical data –no date.

MULTI-PIECE TUB/SHOWER UNIT AND METHOD OF INSTALLATION

FIELD OF INVENTION

This invention relates to the bath and shower industry and more particularly to a multi-piece tub/shower unit having a trackless shower door and a method of assembling and installing same.

BACKGROUND OF INVENTION

Multi-piece tub/shower units have become popular in the bathing industry. These units generally consist of a tub and/or shower and one, two or three sidewalls or a shower floor piece. Each component is manufactured from either gelcoated fiberglass or a Sheet Molded Compound where the compound is primarily fiberglass. The gelcoated fiberglass requires a lay-up manufacturing process, while the sheet molded compound is a close mold process. As part of the installation process, the components are assembled on site and secured to a bathroom wall stud and pocket.

Alternate embodiments may also include a shower door mounted slidably upon a shower door track secured to the bathtub unit.

Because of the nature of this product it is important that a water tight seal be obtained upon assembly and installation. Present designs and methods of assembly and installation do not achieve a maximized water tight seal. Further, these methods generally require bolting the component pieces together by drilling holes into the surfaces of the sidewalls, backwall and bathtub unit. The piercing of the surface of the walls degrades the ultimate sealing of the unit and creates more places through which water may leak. Further, piercing requires the additional step of caulking around the bolted areas in order to create a better seal.

The major problem with the current multi-piece tub/showers is that they must be bolted together before the unit is installed. This is so because the bolting method requires the installer to bolt from the back of the unit, which cannot be done if the components are individually secured to the bathroom wall studs in advance. In a small 5'×7' bathroom, this is an impossible task, and in larger bathrooms the installer is caused the inconvenience of removing all the other products to allow room for the tub/shower to be shifter for bolting and for installation.

Other methods of assembly and installation utilize an interlocking method by which male and female couplings are an integral part of the backwall and sidewalls. Currently, the only method by which these units are manufactured is the Sheet Molded Compound Method. As a result, these units either have a texture or are expensive because of the added step required for gloss.

As a result, there is a need in the industry for a multi-piece tub/shower unit which is installed in pieces and is water tight.

For those embodiments which include a shower door, there exists additional sealing concerns between the shower door, the shower door track and the bathtub unit upon which the track is mounted. The shower door track has a tendency to accumulate water deposits and is difficult to keep clean of soap scum and other deposits which can accumulate within its crevasses. This often creates an unsightly track. In addition, the shower door track makes it uncomfortable to lean over the bathtub ledge when cleaning the inside of the tub sump. As a result, there is a further need in the industry for a trackless shower door.

SUMMARY OF INVENTION

The present invention is a multi-piece tub/shower unit having a trackless shower door and a method of assembly and installation of the same wherein the multi-piece tub/shower unit is comprised of a first sidewall, having a sidewall nailing flange and a front flanged surface, and a shower door water retaining bead as an integral part of the front flanged surface and further comprising at least one point of assembly having a debossed aperture; a backwall, having a backwall nailing flange and at least one point of assembly having a debossed aperture, whereby the backwall and the first sidewall are interconnected at the point of assembly by a christmas tree clip, having a first ribbed shank, a second ribbed shank and a shank head, whereby the christmas tree clip is inserted flushly within the debossed aperture of the point of assembly; the multi-piece tub/shower unit is further comprised of a bathtub unit having a tub nailing flange and a tub top ledge wherein the tub top ledge is comprised of an apron ledge having a shower door water retaining bead; the bathtub unit being further comprised of a first front corner which flushly receives the front flange surface of the first sidewall; and a trackless shower door assembly comprised of a first shower door, a second shower door, a header assembly and a center guide, wherein the first shower door and the second shower door are slidably secured within and between the header assembly and the center guide.

Accordingly, it is an object of this invention to produce a multi-piece tub/shower unit which is easy to manufacture, assemble and install.

Another object of this invention is to produce a multi-piece tub/shower unit which creates a maximum watertight seal upon assembly and installation.

A further object of this invention is to produce a multi-piece tub/shower unit whose assembly does not require piercing of the sidewalls, backwall or bathtub unit.

Yet, still another object of this invention is to produce a multi-piece tub/shower unit having a trackless shower door.

DETAILED DESCRIPTION OF THE DRAWINGS

Figure 1:
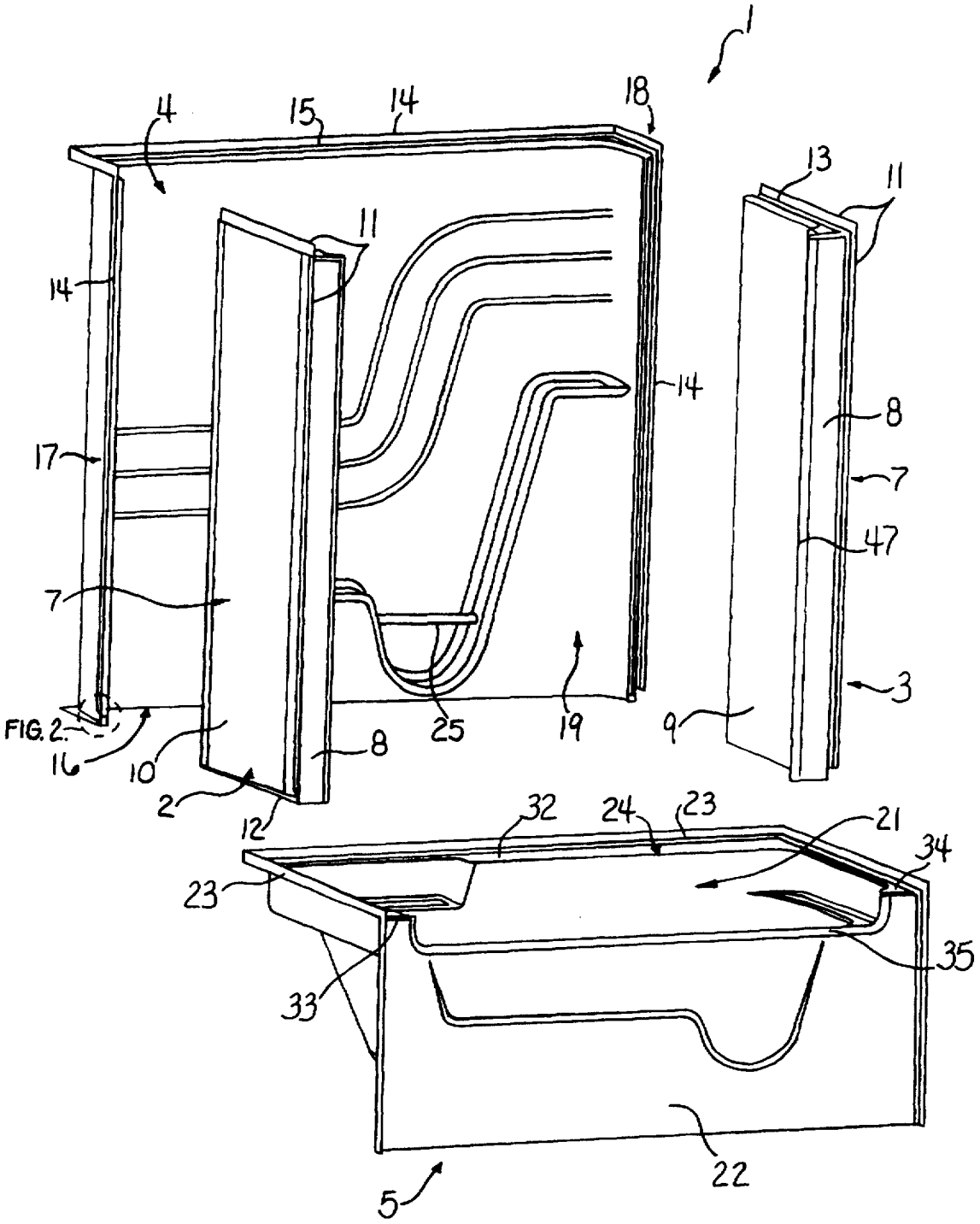
FIG. 1 is an exploded view of the multi-piece bath unit.
Figure 8:
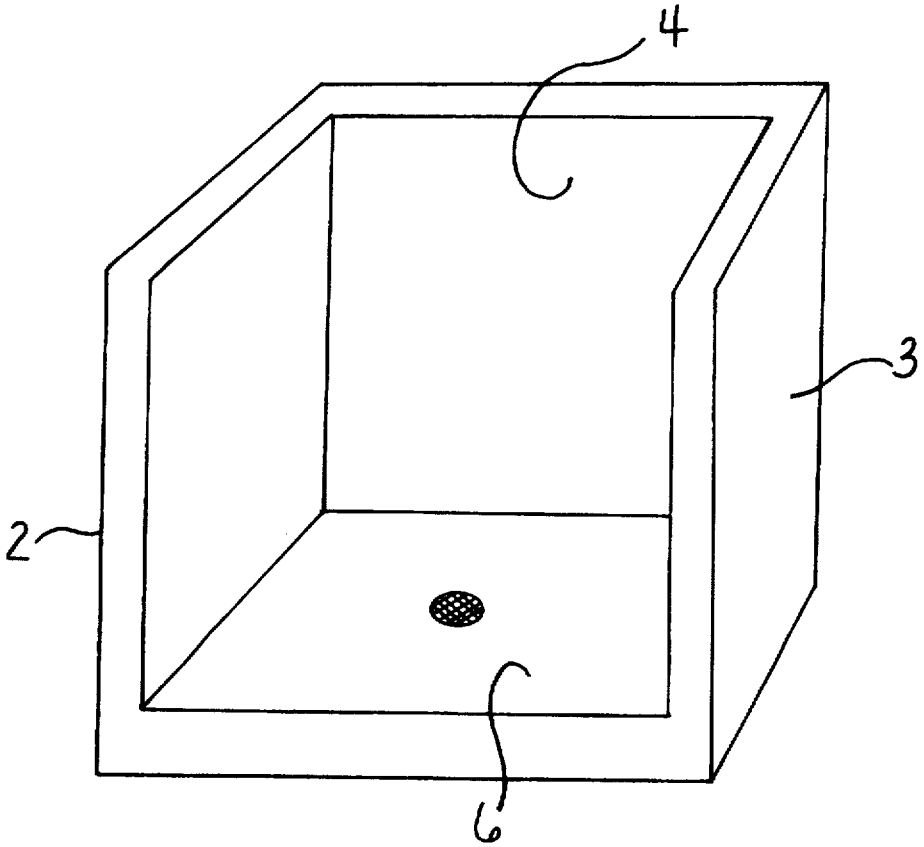
FIG. 8 is a view of the shower floor unit.

FIG. 1 is an exploded view of multi-piece tub/shower unit 1 comprised of first sidewall 2, second sidewall 3, backwall 4 and bathtub unit 5. In an alternate embodiment shower floor unit 6 (see FIG. 8) may replace the bathtub unit if the later is not desired.

In the preferred embodiment the first sidewall is the wet wall because it is the wall in which the plumbing fixtures come through, while the second sidewall is the fitting wall.

In the preferred embodiment the first sidewall, second sidewall, backwall and bathtub unit are manufactured from fiberglass. In alternate embodiments the components of the multi-piece bath unit may be manufactured of any waterproof sheet molding compound.

The first sidewall and the second sidewall are comprised of endwall 7, front flanged surface 8, shower door water retaining bead 47, sidewall face surface 9, sidewall outside surface 10, sidewall nailing flange 11, sidewall bottom ledge 12 and sidewall top ledge 13. In the preferred embodiment the shower door water retaining bead is an integral part of the front flanged surface.

Figure 9:
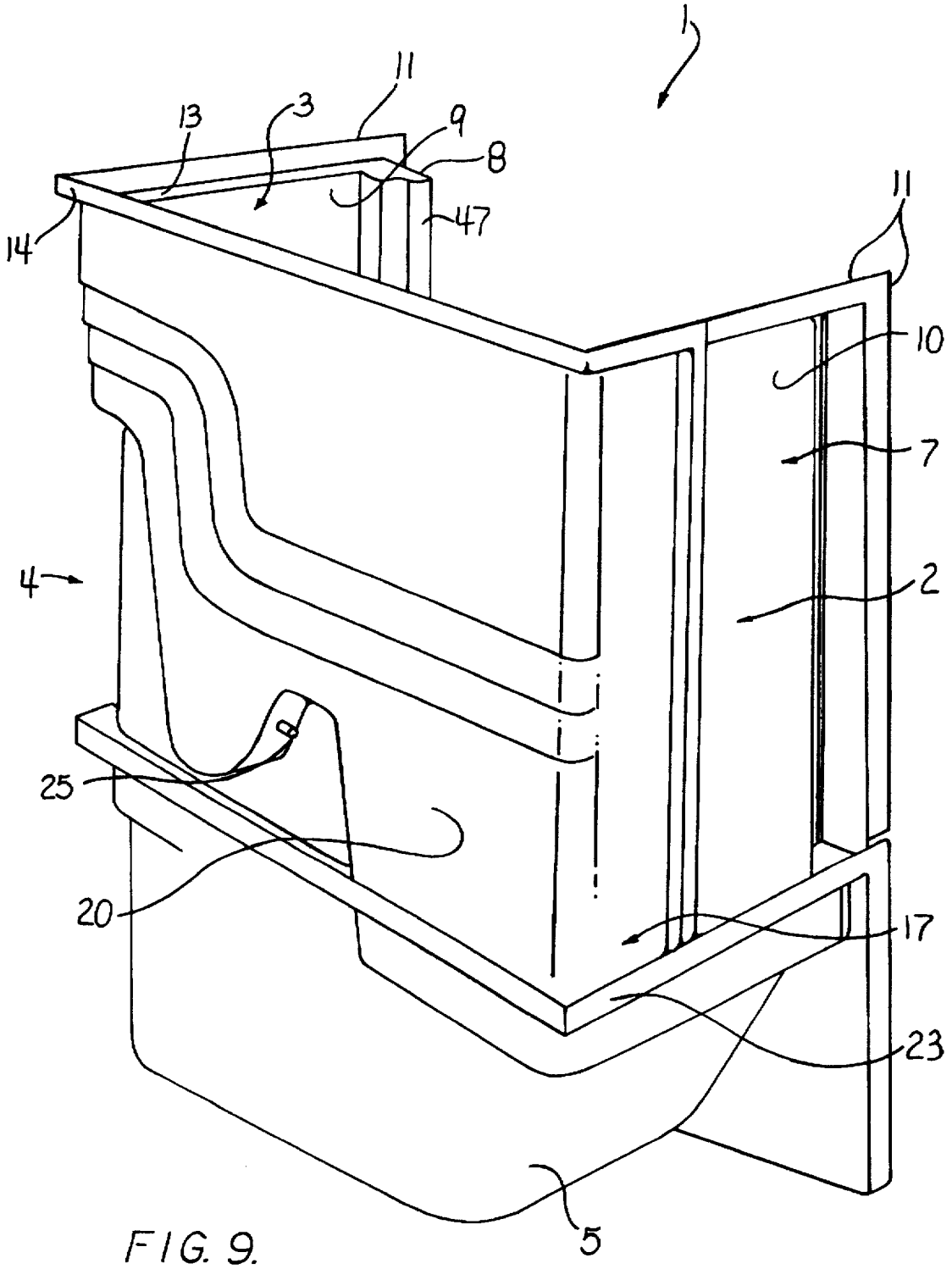
FIG. 9 is a rotated view of FIG. 1 showing the backwall outside surface.

The backwall is comprised of backwall nailing flange 14, backwall top ledge 15, backwall bottom ledge 16, first backwall return for endwall 17, second backwall return for endwall 18, backwall face surface 19 and backwall outside surface 20 (see FIG. 9).

In an alternate embodiment the backwall is further comprised of grab bar 25, which is an integral part of the backwall face surface.

The bathtub unit is comprised of tub sump 21, front apron 22, tub nailing flange 23 and tub top ledge 24. The tub top ledge is comprised of a tub back ledge 32, a first tub side ledge 33, a second tub side ledge 34 and a apron ledge 35. While the tub back ledge, first tub side ledge and second tub side ledge are all on the same plane, the apron ledge is on a lower plane than these other components. Thus, the tub top ledge is a multi-level surface. In the preferred embodiment an integral part of the apron ledge is shower door water retaining bead 47.

Figure 3:
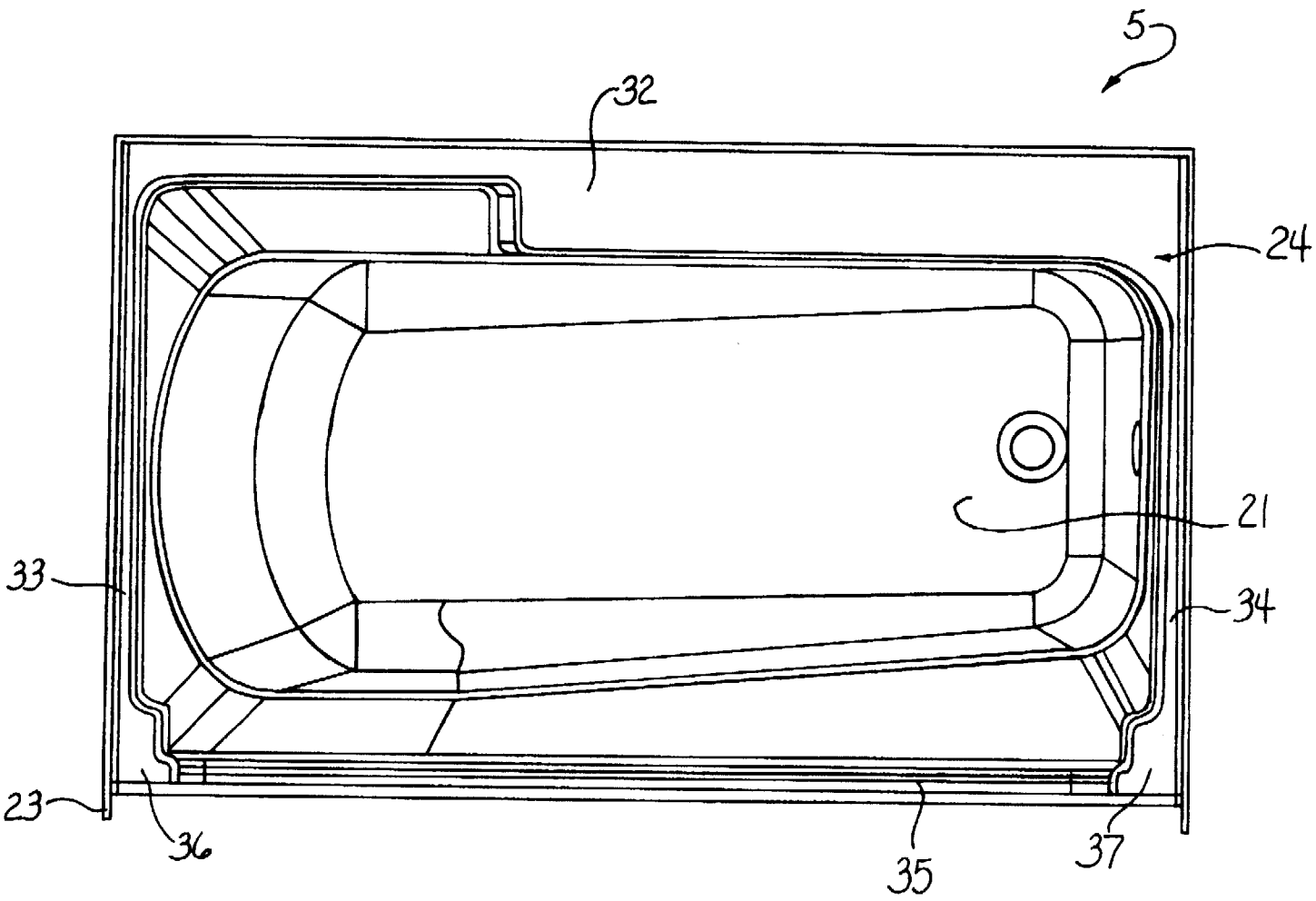
FIG. 3 is a top view of the bathtub unit.

As shown in FIG. 3, first front corner 36 and second front corner 37 of the tub top ledge are designed so as to flushly receive the front flanged surface of the first sidewall and the front flanged surface of the second sidewall, respectively, when the sidewall bottom ledge is mounted over the first tub side ledge and second tub side ledge, respectively, of the bath tub unit.

Figure 2:
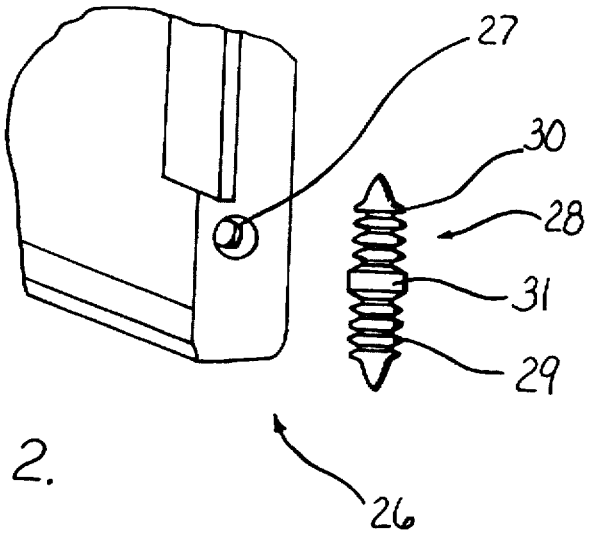
FIG. 2 close-up cut away view of the point of assembly.

The backwall, first sidewall and second sidewall are each further comprised of at least one point of assembly 26. A point of assembly for the backwall is shown in FIG. 2. The point of assembly is comprised of debossed aperture 27. For each point of assembly on the backwall there is a corresponding point of assembly on the endwall of either the first sidewall or the second sidewall.

christmas tree clip 28, shown in FIG. 2, is comprised of first ribbed shank 29, second ribbed shank 30 and shank head 31.

In the preferred method of installation and assembly the bathtub unit is first leveled and then secured into place by drilling and nailing through the tub nailing flange and into the studs of the bathroom wall.

The second step is to place the backwall onto the bathtub unit such that the backwall bottom ledge rests flush upon the tub back ledge and in front of the tub nailing flange. To secure the backwall, drill and nail through the backwall nailing flange into the corresponding bathroom wall studs.

The third step is to insert the first ribbed shank of the christmas tree clip into each point of assembly on the first backwall return for endwall and the second backwall return for endwall. In the preferred assembly of the backwall to the first sidewall, the first ribbed shank is inserted into the debossed aperture of the backwall.

The fourth step is to place the first sidewall and the second sidewall on the first tub side ledge and second tub side ledge, respectively, of the tub top ledge of the bathtub unit. Next, register and insert into the debossed aperture, at the point of assembly, the second ribbed shank of the corresponding christmas tree clip already secured within the backwall. Thus, the corresponding debossed aperture of the first sidewall is inserted over the second ribbed aperture such that the shank head is encapsulated by the debossed apertures and the first backwall return for endwall and the endwall are flush. A corresponding method is used to assemble the backwall to the second sidewall. In the preferred assembly caulking is placed along the points of assembly.

The first sidewall is then secured to the bathroom wall studs by drilling and nailing through the sidewall nailing flange. Likewise, the second sidewall is secured to the bathroom wall studs by drilling and nailing through the sidewall nailing flange.

Figure 4:
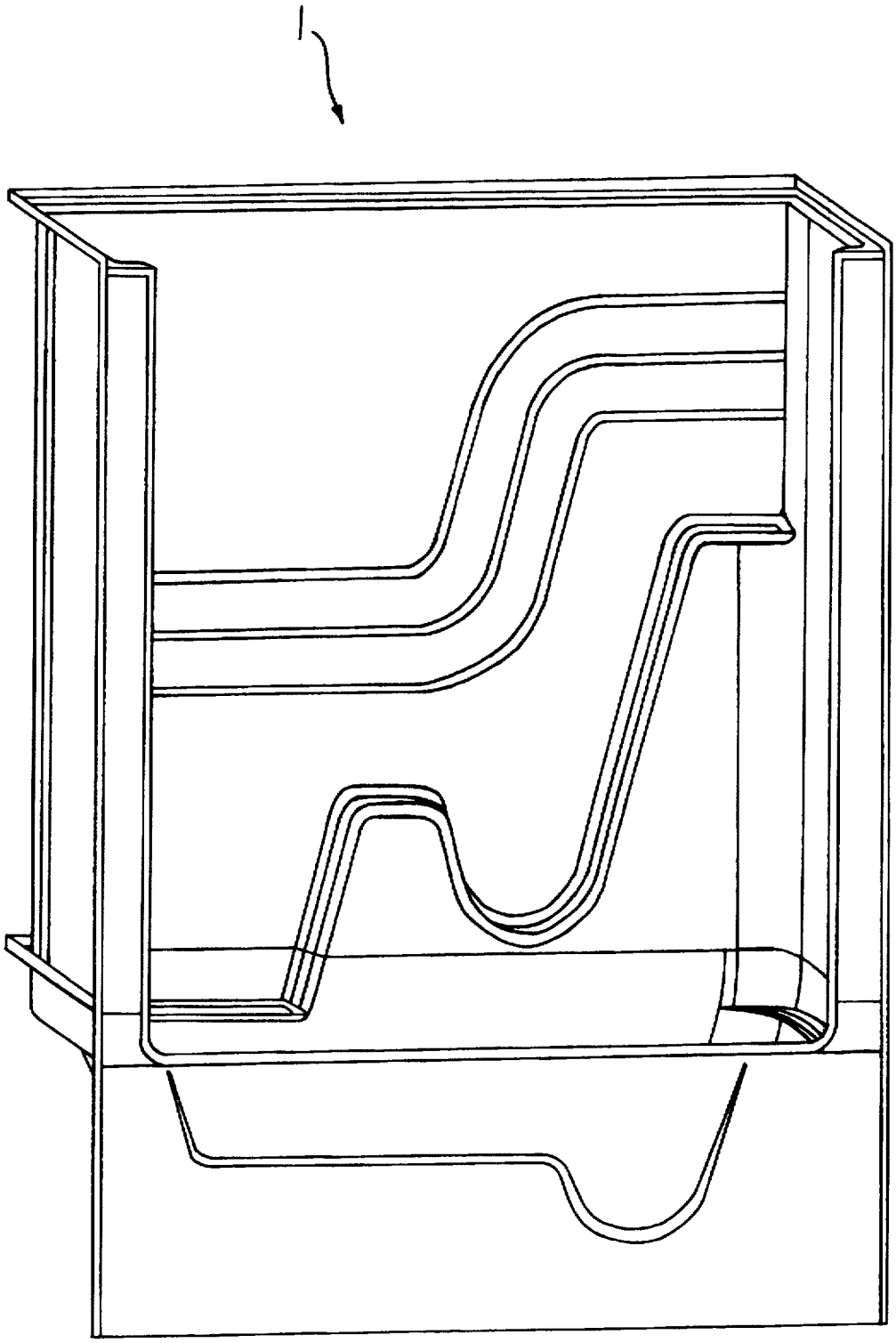
FIG. 4 is a view of the assembled multi-piece bath unit.

The invention as assembled is shown in FIG. 4.

Figure 5:
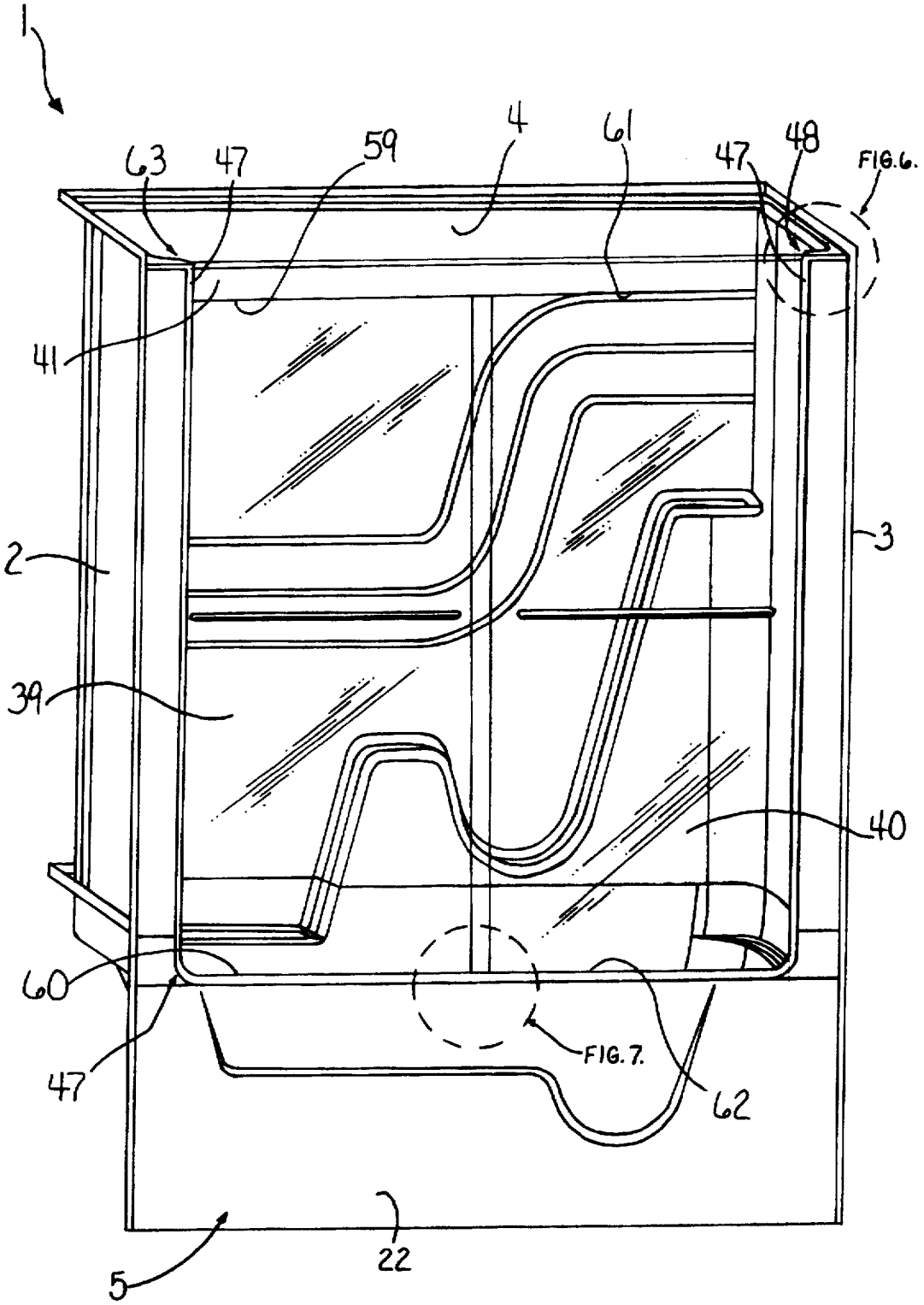
FIG. 5 is a view of the multi-piece bath unit with the trackless shower door.

In an alternate embodiment the multi-piece tub/shower unit also includes trackless shower door assembly as shown in FIG. 5.

The trackless shower door assembly includes a first shower door 39 and a second shower door 40, header assembly 41 and center guide 42.

Figure 6:
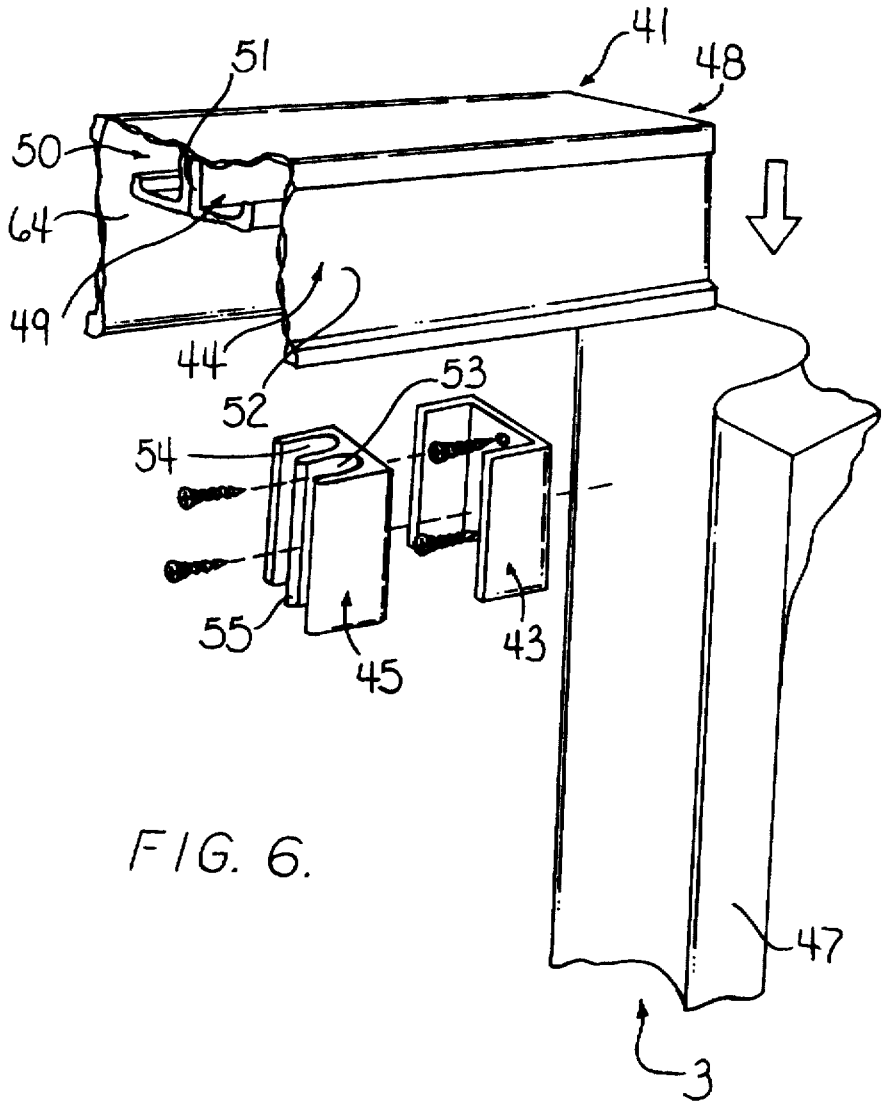
FIG. 6 partial exploded view of the trackless shower door header.

As shown in FIG. 6 the header assembly is comprised of at least one clip 43 which is mounted to the sidewall face surface and which secures header 44 in place. The header assembly is further comprised of glass receiver 45, mounted within the clip. The glass receiver slidably secures the first shower door and the second shower door within the header assembly.

As shown in FIGS. 5 and 6, the header is mounted between the first sidewall 2 and the second sidewall 3 and is mountably attached at a header first end 63 to the sidewall face surface of the first sidewall, behind shower door water retaining bead 47, by at least one clip and is mountably attached at a header second end 48 to the sidewall face surface of the second sidewall, behind shower door water retaining bead 47, by at least one clip. The header is further comprised of a first header slot 49 and a second header slot 50. The first header slot is separated from the second header slot by header spacer 51.

The first shower door is comprised of a first shower door top 59 and a first shower door bottom 60. The second shower door is comprised of a second shower door top 61 and a second shower door bottom 62.

The first header slot slideably receives the first shower door within the header at the first shower door top, between the header spacer and header front 52. The second header slot slideably receives the second shower door within the header at the second shower door top, between the header spacer and the header back 64.

The glass receiver is comprised of a first glass receiver slot 53 and a second glass receiver slot 54. The first glass receiver slot is separated from the second glass receiver slot by glass receiver spacer 55. The first shower door, when moved along the header within the first header slot to the header first end, is secured to the first sidewall when received by the first glass receiver slot of the glass receiver mounted to the sidewall face surface of the first sidewall. Similarly, the first shower door, when moved along the header within the first header slot to the header second end, is secured to the second sidewall when received by the first glass receiver slot of the glass receiver mounted to the sidewall face surface of the second sidewall. Similarly, the second shower door, when moved along the header within the second header slot to the header first end, is secured to the first sidewall when received by the second glass receiver slot of the glass receiver mounted to the sidewall face surface of the second sidewall. Likewise, the second shower door, when moved along the header within the second header slot to the header second end, is secured to the second sidewall when received by the second glass receiver slot of the glass receiver mounted to the sidewall face surface of the second sidewall. The header spacer and the glass receiver spacer operate to provide spacing between the first shower door and the second shower door. The header spacer further allows the first shower door and the second shower door to slide within the header past and alongside one another without contacting one another.

The first shower door and second shower door is further slidably secured by the center guide (Shown in FIG. 7) which is mounted to the apron ledge of the tub top ledge of the bathtub unit.

Figure 7:
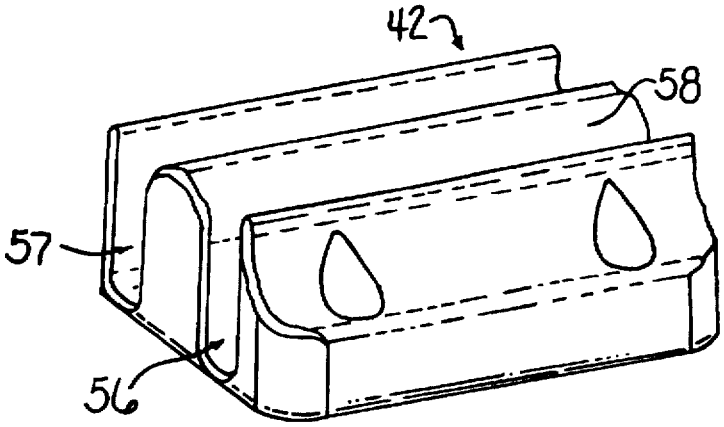
FIG. 7 is an isolated side view of the center guide for the trackless shower door.

As shown in FIG. 7, the center guide is comprised of a first center guide slot 56, a second center guide slot 57 and a center guide spacer 58. The center guide operates to provide spacing between the first shower door and the second shower door and to allow the first shower door and the second shower door to move over the apron ledge of the tub top ledge of the bathtub unit behind the shower door water retaining bead. The first shower door is supported over the apron ledge, behind the shower door water retaining bead, by having the first shower door bottom 60 received within the first center guide slot. The second shower door is supported over the apron ledge, behind the shower door water retaining bead, by having the second shower door bottom 62 received within the second center guide slot. The second center guide slot is separated from the first center guide slot by the center guide spacer. As a result of their positioning within the header and the center guide and the spacing provided thereby, the first shower door and the second shower door are able to slide past one another as they are moved to and fro between the first sidewall and the second sidewall.

The shower door water retaining bead located on the apron ledge and the front flanged surface of the first sidewall and second sidewall operate by design to create a dam preventing water from leaking through the trackless shower door assembly. This thereby eliminates the need for the conventional side channels and bottom tracks.

We claim:

1. A multi-piece tub/shower unit comprised of:

(a) a first sidewall, having a sidewall nailing flange and a front flanged surface, wherein a shower door water retaining bead is an integral part of the front flanged surface and further comprising at least one point of assembly having a debossed aperture;

(b) a backwall, having a backwall nailing flange and at least one point of assembly having a debossed aperture; said backwall and said first sidewall being interconnected at said point of assembly with a christmas tree clip, having a first ribbed shank, a second ribbed shank and a shank head, inserted flushly within said debossed aperture of said point of assembly; and (c) a bathtub unit having a tub nailing flange and a tub top ledge wherein said tub top ledge is comprised of an apron ledge having a shower door water retaining bead; said bathtub unit being further comprised of a first front corner wherein said first front corner flushly receives said front flange surface of said first sidewall; wherein further said backwall being mountably attached to said tub top ledge surface.

2. The multi-piece tub/shower unit of claim 1 being further comprised of a trackless shower door assembly comprised of a first shower door, a second shower door, a header assembly and a center guide, wherein said first shower door and said second shower door are slidably secured within and between said header assembly and said center guide.

3. The multi-piece tub/shower unit of claim 2 wherein said header assembly is comprised of a header, at least one clip mounted to said first sidewall securing said header in place and a glass receiver mounted within said clip, wherein said glass receiver slidably secures said first shower door and said second shower door within the header assembly.

4. The multi-piece tub/shower unit of claim 2 wherein said center guide is mounted to the tub top ledge of the bathtub unit.

5. The multi-piece tub/shower unit of claim 2 wherein said header assembly is comprised of a header, at least one clip mounted to said first sidewall securing said header in place, wherein said header is further comprised of a header front, a header back, a first header end, a second header end, a first header slot and a second header slot, whereby the first header slot is separated from the second header slot by a header spacer; and whereby the first header slot slideably receives the first shower door, having a first shower door top and a first shower door bottom, within the header, between the header spacer and the header front, at a first shower door top; and whereby the second header slot slideably receives the second shower door, having a second shower door top and a second shower door bottom, within the header, between the header spacer and the header back, at the second shower door top; said header assembly being further comprised of at least one glass receiver mounted within said clip, wherein said glass receiver is comprised of a first glass receiver slot and a second glass receiver slot, wherein the first glass receiver slot is separated from the second glass receiver slot by a glass receiver spacer; and wherein the first shower door when moved along the header within the first header slot is secured to the first sidewall when received by the first glass receiver slot of the glass receiver mounted to the first sidewall and wherein the second shower door when moved along the header within the second header slot is secured to the first sidewall when received by the second glass receiver slot of the glass receiver mounted to the first sidewall; and further wherein said center guide is comprised of a first center guide slot, a second center guide slot and a center guide spacer, wherein the center guide spacer separates the first center guide slot from the second center guide slot, the center guide being mounted to the apron ledge of the tub top ledge supports the first shower door bottom over the apron ledge, behind the shower door water retaining bead, within the first center guide slot, and wherein the center guide supports the second shower door bottom over the apron ledge, behind the shower door water retaining bead, within the second center guide slot.

6. The multi-piece tub/shower unit of claim 1 wherein a grab bar is an integral part of said backwall.

7. A method of assembling and installing a multi-piece tub/shower unit into a bathroom having bathroom wall studs comprised of the steps of:

(a) leveling a bathtub unit having a tub nailing flange and a tub back ledge, and securing said bathtub unit by drilling and nailing through the tub nailing flange and into the bathroom wallstuds;

(b) placing a backwall having a backwall nailing flange and a backwall bottom ledge, onto the bathtub unit such that the backwall bottom ledge rests flush upon the tub back ledge and in front of the tub nailing flange and securing the backwall by drilling and nailing through the backwall nailing flange into the bathroom wall studs;

(c) inserting a first ribbed shank of a christmas tree clip into a debossed aperture located at a point of assembly on the backwall;

(d) placing the first sidewall on the tub top ledge of the bathtub unit and registering and inserting into the debossed aperture at the point of assembly of the first sidewall a second ribbed shank of the corresponding christmas tree clip already secured within the backwall such that the backwall and the sidewall are flush; and (e) securing the first side wall to the bathroom wall studs by drilling and nailing through the sidewall nailing flange.

* * * * *